US007874439B2

(12) United States Patent
Waisanen

(10) Patent No.: US 7,874,439 B2
(45) Date of Patent: Jan. 25, 2011

(54) OVERHEAD CRANE

(75) Inventor: Steven K. Waisanen, Big Bend, WI (US)

(73) Assignee: MHE Technologies, Inc., Wilmington, DE (US)

( * ) Notice: Subject to any disclaimer, the term of this patent is extended or adjusted under 35 U.S.C. 154(b) by 0 days.

(21) Appl. No.: 11/995,946

(22) PCT Filed: Jul. 21, 2005

(86) PCT No.: PCT/US2005/025930

§ 371 (c)(1),
(2), (4) Date: Nov. 20, 2008

(87) PCT Pub. No.: WO2007/018487

PCT Pub. Date: Feb. 15, 2007

(65) Prior Publication Data

US 2009/0159548 A1 Jun. 25, 2009

(51) Int. Cl.
*B66C 19/00* (2006.01)

(52) U.S. Cl. ..... 212/317; 212/318; 212/224; 212/225

(58) Field of Classification Search ..... 212/315, 212/316–317, 223–225
See application file for complete search history.

(56) References Cited

U.S. PATENT DOCUMENTS

| | | | | | |
|---|---|---|---|---|---|
| 734,187 | A | * | 7/1903 | Matthews | 212/224 |
| 1,008,218 | A | * | 11/1911 | Taylor | 414/279 |
| 1,768,542 | A | * | 7/1930 | Clausing | 212/224 |
| 2,317,689 | A | * | 4/1943 | Medenwald | 105/153 |
| 2,416,352 | A | * | 2/1947 | Seward | 104/107 |
| 2,499,442 | A | * | 3/1950 | Wright | 414/543 |
| 2,772,794 | A | | 12/1956 | Cramer et al. | |
| 2,846,081 | A | * | 8/1958 | Moore et al. | 212/317 |
| 3,540,603 | A | | 11/1970 | Neumeier | |
| 3,770,137 | A | * | 11/1973 | Slutsky et al. | 212/315 |
| 3,814,211 | A | * | 6/1974 | Pamer | 182/14 |
| 4,449,634 | A | * | 5/1984 | Buzzichelli et al. | 212/196 |
| 5,064,079 | A | * | 11/1991 | Bowerman | 212/345 |
| 5,186,343 | A | * | 2/1993 | Bozzi | 212/291 |
| 6,058,849 | A | * | 5/2000 | Ostholt et al. | 104/93 |
| 7,686,175 | B2 | * | 3/2010 | Waisanen | 212/315 |

FOREIGN PATENT DOCUMENTS

| | | | | |
|---|---|---|---|---|
| DE | 3611716 | A1 | | 10/1987 |
| GB | 2 837 832 | A | * | 10/2003 |
| SU | 1463701 | A | * | 3/1989 |
| WO | WO 2006/028994 | A2 | | 3/2006 |

* cited by examiner

*Primary Examiner*—Thomas J Brahan
(74) *Attorney, Agent, or Firm*—Porter, Wright, Morris & Arthur, LLP

(57) ABSTRACT

An overhead crane adapted to be supported by at least one main support beam includes a bridge adapted to travel in a substantially horizontal direction along the at least one main support beam, a trolley adapted to travel in a substantially horizontal direction along the bridge, a jib rotatably coupled to a bottom surface of the trolley, and a hoist adapted to travel in a substantially horizontal direction along the jib.

20 Claims, 3 Drawing Sheets

OVERHEAD CRANE

BACKGROUND

The present invention relates to overhead cranes. More particularly, the present invention relates to an overhead crane including a trolley and positionable hoist that eliminates side loading of the crane.

Conventional overhead cranes include a frame with a pair of bridge cross members that move along a pair of main support beams. A pair of tracks are supported by the cross members and a hoist moves along the pair of tracks in a direction transverse to the main support beams. Such a configuration does not permit the hoist to lift loads positioned outside the perimeter defined by the main support beams. Further, to lift loads positioned outside the runway defined by the cross members or directly under one of the cross members, side loading of the hoist results, which is unsafe and a violation of the Occupational Safety and Health Administration regulations. An overhead crane that permits positioning of the hoist directly over the load, regardless of the location of load within a crane bay, would be welcomed by users of overhead cranes.

SUMMARY

In one embodiment, the invention provides an overhead crane adapted to be supported by at least one main support beam. The overhead crane includes a bridge adapted to travel in a substantially horizontal direction along the at least one main support beam, a trolley adapted to travel in a substantially horizontal direction along the bridge, a jib rotatably coupled to a bottom surface of the trolley, and a hoist adapted to travel in a substantially horizontal direction along the jib.

In another embodiment, the invention provides an overhead crane adapted to be supported by first and second main support beams that are spaced apart and generally parallel. The overhead crane includes a bridge adapted to travel along an underside of the main support beams, and the bridge includes first and second girders aligned transversely to the main support beams wherein the first and second girders are spaced apart and generally parallel. A trolley is adapted to travel along the first and second girders of the bridge, and the trolley includes a rotate bearing at a bottom surface of the trolley. A rail is coupled to the rotate bearing and the rail rotates with the rotate bearing relative to the trolley. A hoist is adapted to travel along an underside of the rail with the hoist being positionable outside a perimeter defined by the main support beams.

In yet another embodiment, the invention provides an overhead crane. The overhead crane including at least one main support beam that extends between two walls of a facility, a bridge adapted to travel along the at least one main support beam and including first and second girders being spaced apart and generally parallel, a trolley adapted to travel along the bridge, and a jib rotatably coupled to a bottom surface of the trolley and including a first end and a second end. A first hoist is adapted to travel along an underside of the jib, the hoist being movable from the first end of the jib along a portion of the jib, and a second hoist is coupled to the second end of the jib and fixed relative to the jib.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
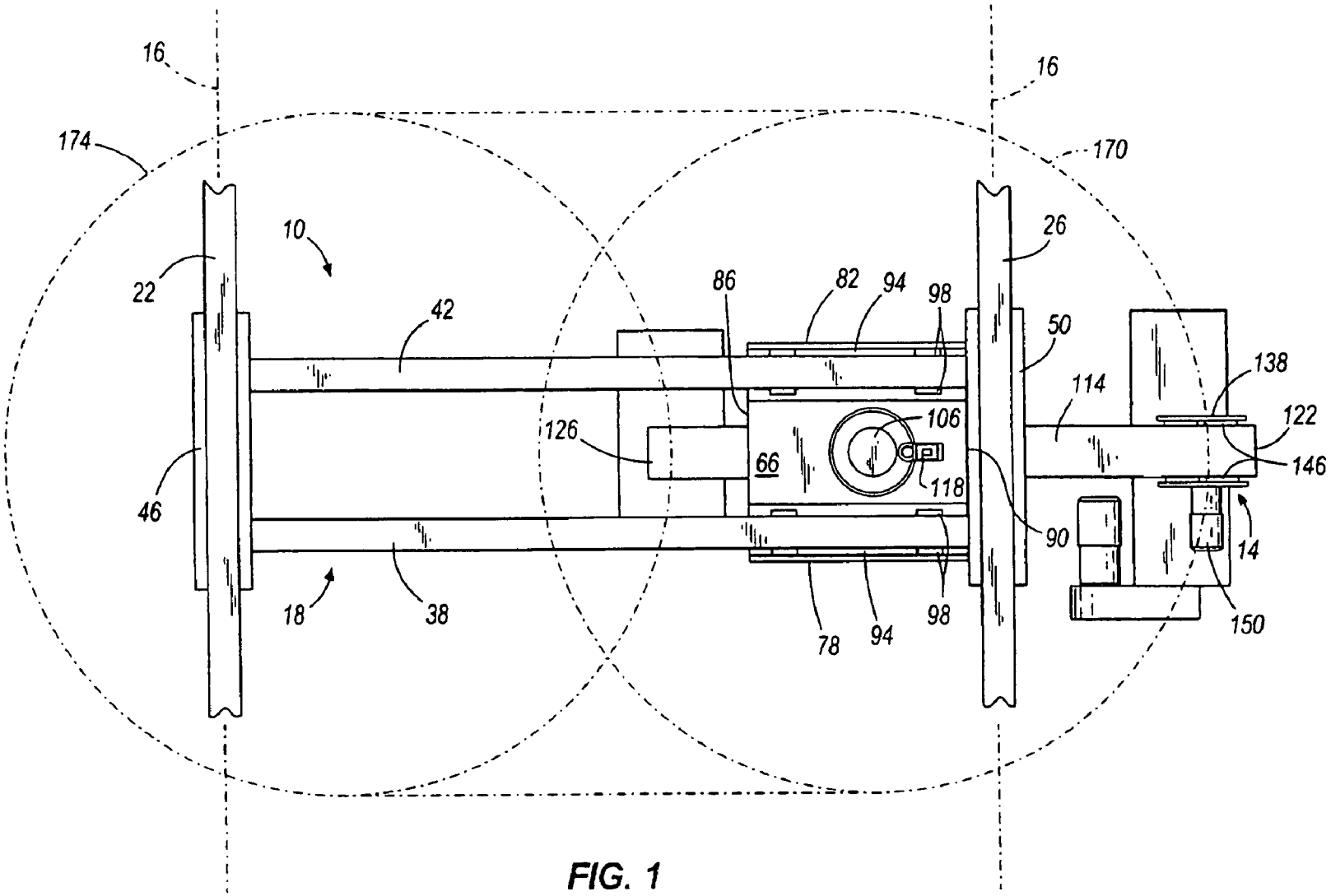
FIG. 1 illustrates a top view of a crane including a trolley and underrunning with a traveling hoist according to the present invention.
Figure 2:
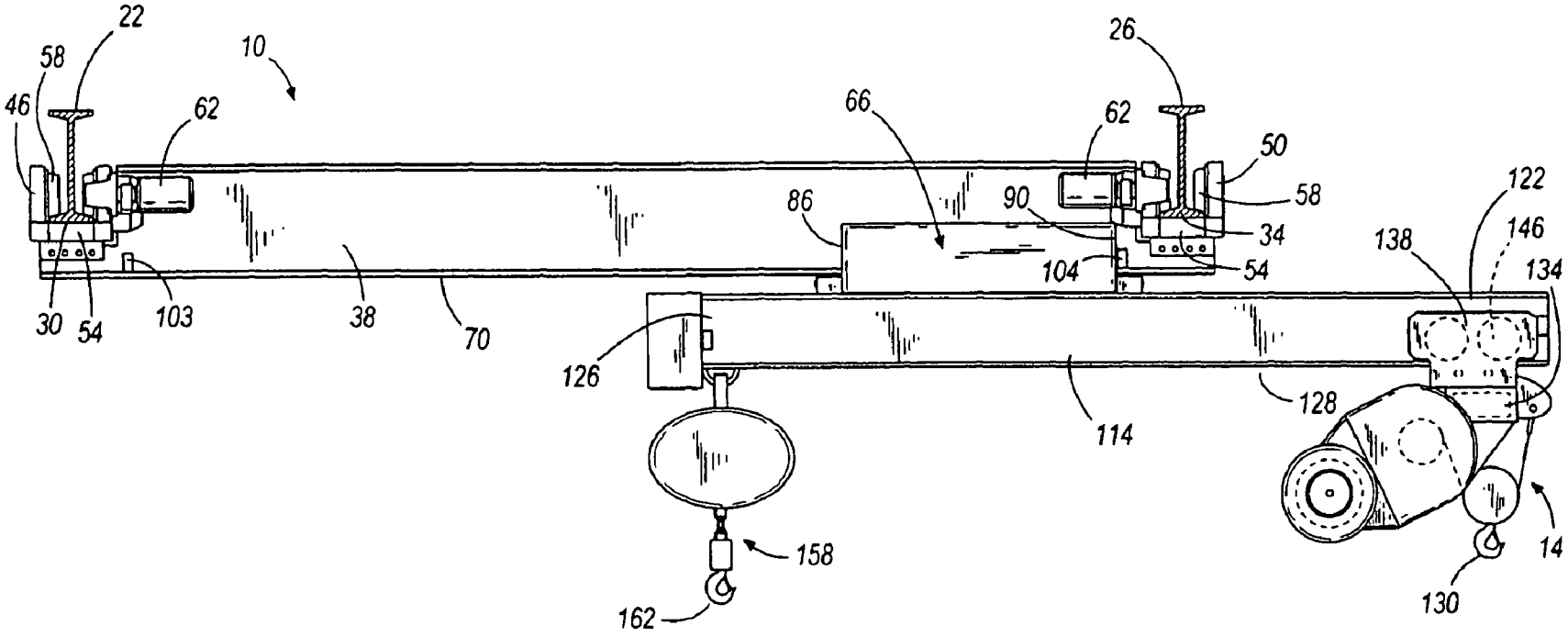
FIG. 2 illustrates a side view of the crane shown in FIG. 1.
Figure 3:
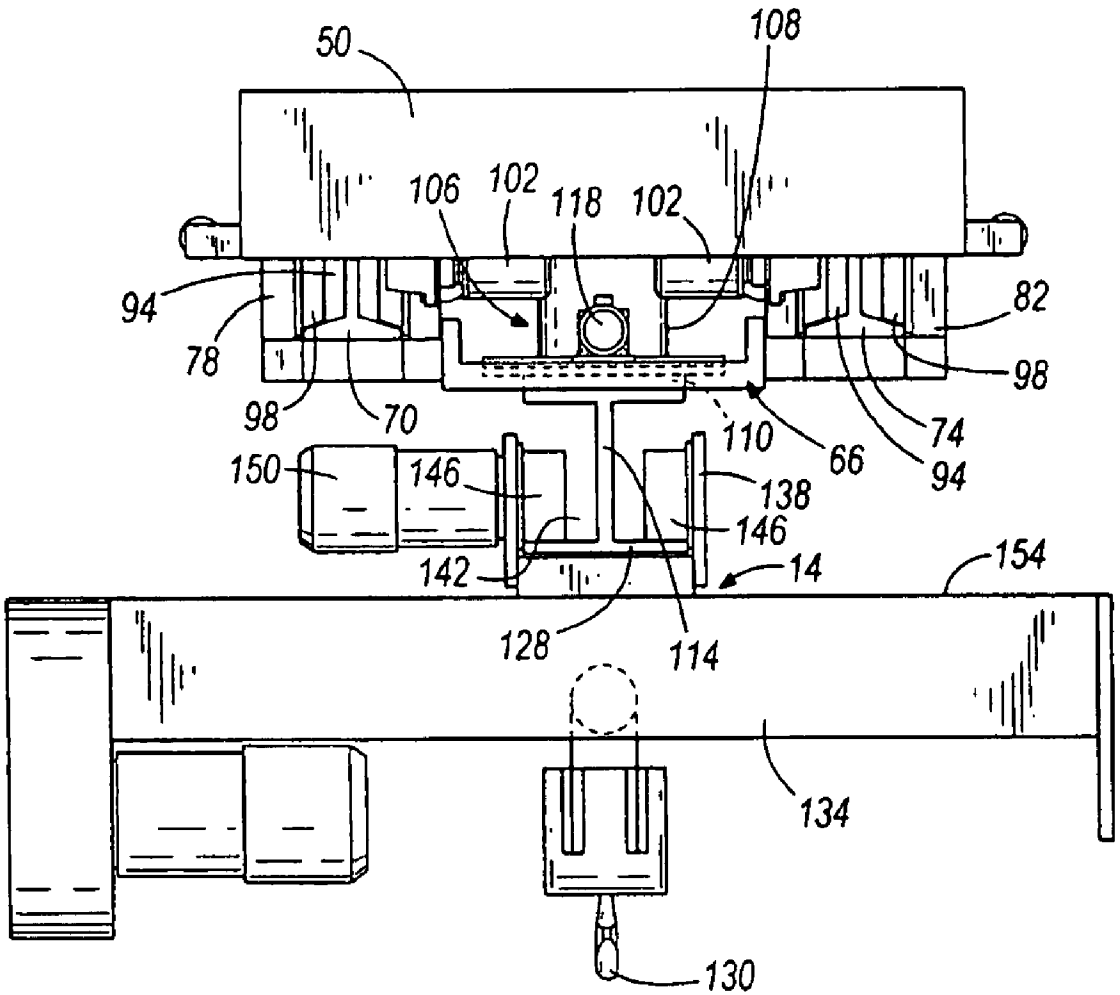
FIG. 3 illustrates an end view of the crane shown in FIG. 1.

FIGS. 1-3 illustrate an overhead crane 10 that positions a hoist 14 in a crane bay for lifting and unloading a load. Further, the crane 10 allows the hoist 14 to lift a load positioned outside a perimeter 16 defined by main support beams 22, 26 of the crane 10.

The overhead crane 10 includes a bridge 18 that translates along a first main support beam 22 and a second main support beam 26. The main support beams 22, 26 generally extend between two walls (not shown) of a facility and are spaced apart and generally parallel to each other. As will be readily known to those of skill in the art, the main support 22, 26 beams may alternatively be curved to match the inside wall contours of a round building, or include a single, curved support beam. For example, a polar crane similar to the crane 10 may be used in a nuclear containment building that is built in a round configuration, in which case the main support beam(s) will be shaped in a circle instead of a straight line.

Undersides of the first and second main support beams 22, 26 define rails 30, 34 that the bridge 18, or first underrunning, travels along. The bridge 18 travels in a substantially horizontal direction. The carriage includes a first girder 38, a second girder 42, and a pair of end trucks 46, 50 that extend between the first and second girders 38, 42. The end trucks 46, 50, or U-shaped channel members, are aligned generally parallel to the main support beams 22, 26. Each end truck 46, 50 defines a passage 54 for receiving one of the main support beam rails 30, 34. A pair of wheels 58 is disposed in each passage 54 to facilitate travel of the bridge 18 along the rails 30, 34. A motor 62 is interconnected with each pair of wheels 58 to drive the wheels 58 and thereby cause movement of the bridge 18 along the main support beams 22, 26. As will be readily known to those skilled in the art, any number of driven wheels may be disposed in the end trucks 46, 50. Further, idle wheels may be disposed in the end trucks 46, 50 to facilitate travel of the bridge 18 along the main support beans 22, 26.

The first and second girders 38, 42 are spaced apart from each other and generally parallel. The girders 38, 42 are aligned transversely to the main support beams 22, 26. A trolley 66, or second underrunning, travels along girder rails 70, 74 that are positioned on the undersides of the first and second girders 38, 42. In the illustrated embodiment, the trolley 66 travels in a substantially horizontal direction, generally parallel to the first and second girders 38, 42.

The trolley 66 includes a pair of end trucks 78, 82 that extend from a first end 86 of the trolley 66 to a second end 90 of the trolley 66 and are aligned generally parallel to the first and second girders 38, 42. Each end truck 78, 82 defines a passage 94 for receiving one of the girder rails 70, 74. A pair of wheels 98 is disposed in each passage 94 to facilitate travel of the trolley 66 along the rails 70, 74. A motor 102 is interconnected with each pair of wheels 98 to drive the wheels 98 and thereby cause movement of the trolley 66 along the first and second girders 38, 42. As will be readily known to those skilled in the art, any number of driven wheels may be disposed in the end trucks 78, 82. Further, idle wheels may be disposed in the end trucks 78, 82 to facilitate travel of the trolley 66 along the first and second girders 38, 42.

Referring to FIG. 2, first and second stop members 103 and 104 are mounted to the first girder 38. The stop members 103 and 104 prevent the trolley 66 from traveling beyond the stop member and off the girders 38, 42. In another embodiment, stop-members are mounted to the second girder 42 as well.

The trolley 66 includes rotate bearing 106 mounted to the trolley 66. A jib 114 is coupled to the rotate bearing 106 such that the jib 114 rotates with respect to the trolley 66. A motor 118 is interconnected with the rotate bearing 106 to drive the rotate bearing 106 and cause rotation of the rotate bearing 106 relative to the trolley 66. The rotate bearing includes an outer race 108 connected to the trolley 66 and an inner race 110 connected to the jib 114.

The jib 114, or third underrunning, includes a first end 122 and a second end 126. The first hoist 14 is mounted to the first end 122 of the jib 114 and is adapted for travel along the first end 122 of the jib 114. A bottom surface of the jib defines a rail 128 that the first hoist 122 travels along. In the illustrated embodiment, the first hoist 14 travels in a substantially horizontal direction. The first hoist 14 includes a vertically movable load hook 130, a body 134, and an end truck 138. The end truck 138 defines a passage 142 for receiving the jib rail 128. A pair of wheels 146 is disposed in the passage 142 to facilitate travel of the first hoist 14 along the jib rail 128. A motor 150 is interconnected with the pair of wheels 146 to drive the wheels 146 and thereby cause movement of the first hoist 14 along the jib 114.

The end truck 138 is coupled to an upper surface 154 of the body 134 and the load hook 130 is supported by the body 134. In the illustrated embodiment, the first hoist 14 is a wire hoist. In another embodiment, the first hoist 14 includes other configurations for lifting, as will also be readily apparent to those of skill in the art.

A second hoist 158 is attached to the second end 126 of the jib 114. In the illustrated embodiment, the second hoist 158 is a chain hoist is fixed relative to the jib 114 to provide up-ending and down-ending materials. The second hoist 158 includes a vertically movable load hook 162 and is articulated to rotate within a plane defined by the jib 114. In a further embodiment of the crane 10, a second hoist at an opposite end of the jib from the first hoist 14 is not necessary.

The present invention overhead crane 10 permits the hoist 14 to be positionable outside the perimeter 16 (FIG. 1) defined by the main support beams 22, 26 of the crane 10 and eliminates side loading of the crane 10. Translation of the first and second girders 38, 42 along the main support beams 22, 26, translation of the trolley 66 along the first and second girders 38, 42, rotation of the jib 114 relative to the trolley 66, and translation of the first hoist 14 along a portion of the jib 114 allows the crane 10 to position the first hoist 14 directly over a load (not shown) regardless of the location of the load within a crane bay. Use of the rotatable jib 114 and the traveling first hoist 14 enables a load positioned outside the perimeter 16 defined by the main support beams 22, 26 to be lifted by the first hoist 14 without sideloading. For example and as shown in FIG. 1, when the trolley 66 is positioned at its farthest extents along the first and second girders 38, 42, a first reach area 170 and a second reach area 174 of the first hoist 14 define areas in which the first hoist 14 may be positioned to lift a load. The present invention crane expands the lift zone of the first hoist 14 and allows the first hoist 14 to be positioned circumferentially.

Side loading results when using an overhead crane without the rotatable jib 114 and the traveling first hoist 14, to lift loads positioned outside the main support beams 22, 26, or directly under the first and second girders 38, 42. For loads that need to be up or down ended, both hoists (i.e., the first hoist 14 and the second, counter-balance hoist 158) are used, however, the two hoists are typically up to 11 feet apart. This creates a condition where one or both of the hoists are side loaded, that is one hoist is more severely loaded than the other hoist. Further, lifting loads positioned outside the main support beams 22, 26 and/or directly wider the first and second girders 38, 42 results in the hoist side pulling (i.e., the hoist acting horizontally rather than vertically) to pick and lift the load because the hoist cannot be positioned directly over the load. The present invention overhead crane eliminates side loading of the crane 10 and side pulling to lift loads by positioning the first hoist 14 directly over the load regardless of the location of the load within the crane bay. Further, the second hoist 158 is used for up and down ending of loads without the occurrence of side loading.

Although the invention is described with respect to a crane having an under running bridge and an under running trolley, it should be apparent to those skilled in the art that the invention may be used in cranes having different configurations. For example, the invention may be used with a crane having a top ruining bridge and an under running trolley, or a crane having a top running bridge and a top running trolley.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art. Various features and advantages of the invention are set forth in the following claims.

What is claimed is:

1. An overhead crane adapted to be supported by first and second main support beams that are spaced apart and generally parallel, the overhead crane comprising:

a bridge adapted to travel in a substantially horizontal direction along the main support beams;

a trolley adapted to travel in a substantially horizontal direction along the bridge;

a rotate bearing mounted to the trolley;

a horizontally extending jib secured to the rotate bearing so that the jib is secured against movement relative to the rotate bearing and is rotatably coupled to the trolley so that the jib can rotate relative to the trolley;

wherein the jib has a length shorter than the spacing between the main support beams;

a first hoist adapted to travel in a substantially horizontal direction along the jib past the rotate bearing and having a load hook vertically movable relative to the jib;

a second hoist coupled to the jib at a fixed position along the jib and having a load hook vertically movable relative to the jib; and wherein an end of the jib is movable by the trolley beyond the bridge and the main support beams so that the first hoist can be positioned on the end of the jib outside a perimeter defined by the first and second main support beams to lift a load located outside the perimeter without side loading the crane.

2. The overhead crane of claim 1 wherein the bridge includes first and second girders being spaced apart and generally parallel.

3. The overhead crane of claim 2, wherein the first and second girders include rails and wherein the trolley travels along the rails.

4. The overhead crane of claim 2 wherein the first and second girders are aligned transversely to the first and second main support beams.

5. The overhead crane of claim 1 wherein the rotate bearing includes an outer race secured to the bottom of the trolley and an inner race secured to a top of the jib.

6. The overhead crane of claim 1 wherein hoist travels along a length of the jib.

7. The overhead crane of claim 1, wherein the second hoist is a counter-balance hoist coupled to one end of the jib.

8. The overhead crane of claim 1 wherein the jib is secured to the trolley in a fixed horizontal orientation and rotates relative to the trolley about a vertical axis.

9. An overhead crane adapted to be supported by first and second main support beams that are spaced apart and generally parallel, the overhead crane comprising:

a bridge adapted to travel along an underside of the main support beams, the bridge including first and second girders aligned transversely to the main support beams and wherein the first and second girders are spaced apart and generally parallel;

a trolley adapted to travel along the first and second girders of the bridge, the trolley including a rotate bearing at a bottom surface of the trolley;

a horizontally extending rail coupled to the rotate bearing so that the jib is secured against movement relative to the rotate bearing and having a length shorter than the spacing between the main support beams;

wherein the rail rotates with the rotate bearing relative to the trolley;

a first hoist adapted to travel in a substantially horizontal direction along the rail past the rotate bearing and having a load hook vertically movable relative to the rail;

a second hoist coupled to the jib at a fixed position along the jib and having a load hook vertically movable relative to the rail;

wherein an end of the rail is movable by the trolley beyond the bridge and the main support beams so that the first hoist can be positioned on the end of the jib outside a perimeter defined by the main support beams to lift a load located outside the perimeter without side loading the crane.

10. The overhead crane of claim 9, wherein the first and second girders include rails and wherein the trolley travels along the rails.

11. The overhead crane of claim 9 wherein hoist travels along a length of the rail.

12. The overhead crane of claim 9, wherein the second hoist is a counter-balance hoist coupled to one end of the jib.

13. The overhead crane of claim 9 wherein the rail is secured to the trolley in a fixed horizontal orientation and rotates relative to the trolley about a vertical axis.

14. An overhead crane comprising:

first and second spaced apart and parallel main support beams that extend between two walls of a facility;

a bridge adapted to travel along the first and second main support beams, the bridge including first and second girders being spaced apart and generally parallel;

a trolley adapted to travel along the bridge;

a rotate bearing mounted to the trolley;

a horizontally extending jib secured to the rotate bearing so that the jib is secured against movement relative to the rotate bearing and is rotatably coupled to the trolley so that the jib can rotate relative to the trolley;

wherein the jib has a length shorter than the spacing between the main support beams;

wherein the jib has a first end and a second end;

a first hoist adapted to travel along and underside of the jib and having a load hook vertically movable relative to the jib, the first hoist being movable from the first end of the jib along a portion of the jib and past the rotate bearing;

a second hoist coupled to the second end of the jib and fixed relative to the jib; and wherein the first end of the jib is movable by the trolley beyond the bridge and the first and second main support beams so that the first hoist can be positioned on the first end of the jib outside a perimeter defined by the first and second main support beams to lift a load located outside the perimeter without side loading the crane.

15. The overhead crane of claim 14 wherein the first and second girders are aligned transversely to the first and second main support beams.

16. The overhead crane of claim 14, wherein the first and second girders include rails and wherein the trolley travels along the rails.

17. The overhead crane of claim 16 wherein the rails are located at an underside of the first and second girders.

18. The overhead crane of claim 14 wherein the bridge travels along an underside of the first and second main support beams.

19. The overhead crane of claim 14 wherein the the rotate bearing includes an outer race secured to the bottom of the trolley and an inner race secured to a top of the jib.

20. The overhead crane of claim 14 wherein the jib is secured to the trolley in a fixed horizontal orientation and rotates relative to the trolley about a vertical axis.

* * * * *